United States Patent [19]

Staats

[11] 4,023,829

[45] May 17, 1977

[54] HOT MELT ADHESIVE DOT BINDING

[75] Inventor: Henry N. Staats, Deerfield, Ill.

[73] Assignee: General Binding Corporation, Northbrook, Ill.

[22] Filed: Mar. 17, 1975

[21] Appl. No.: 558,895

[52] U.S. Cl. ..... 281/21 R; 156/291
[51] Int. Cl.[2] ..... B42C 9/00; B42D 1/00
[58] Field of Search ..... 156/216, 291, 252; 281/21 R, 29, 36, 37, 22, 23; 11/1 R, 1 AD, 2, 4; 282/22 R, 23 R, 11.5 R, 11.5 A

[56] References Cited

UNITED STATES PATENTS

| | | | |
|---|---|---|---|
| 2,105,448 | 1/1938 | Brenn | 282/11.5 R |
| 2,387,808 | 10/1945 | Pruneau et al. | 281/21 R |
| 2,878,815 | 3/1959 | Pluckebaum | 281/21 R |
| 3,169,029 | 2/1965 | Margolis | 281/29 |
| 3,452,376 | 7/1964 | Ito | 11/1 R |

FOREIGN PATENTS OR APPLICATIONS

| | | | |
|---|---|---|---|
| 1,565,399 | 3/1969 | France | 281/21 R |
| 956,512 | 1/1957 | Germany | 282/22 R |
| 2,057,670 | 6/1971 | Germany | 11/1 R |
| 581,516 | 7/1933 | Germany | 281/21 R |
| 706,149 | 5/1941 | Germany | 282/11.5 R |
| 532,120 | 1/1941 | United Kingdom | 156/291 |
| 690,353 | 4/1953 | United Kingdom | 281/21 A |

*Primary Examiner*—Jerome Schnall
*Attorney, Agent, or Firm*—Hill, Gross, Simpson, Van Santen, Steadman, Chiara & Simpson

[57] ABSTRACT

A method and apparatus for permanently binding sheets of paper into a cover inexpensively and quickly is disclosed. Hot melt adhesive dots are placed near a center fold on one inside surface of a cover in alignment with pre-punched holes in paper sheets to be bound. An opposite surface of the cover is folded over and upon the dots and heat is applied causing a top of each dot to adhere to the adjacent cover surface, thus locking the paper sheets to the cover adjacent the center fold.

2 Claims, 7 Drawing Figures

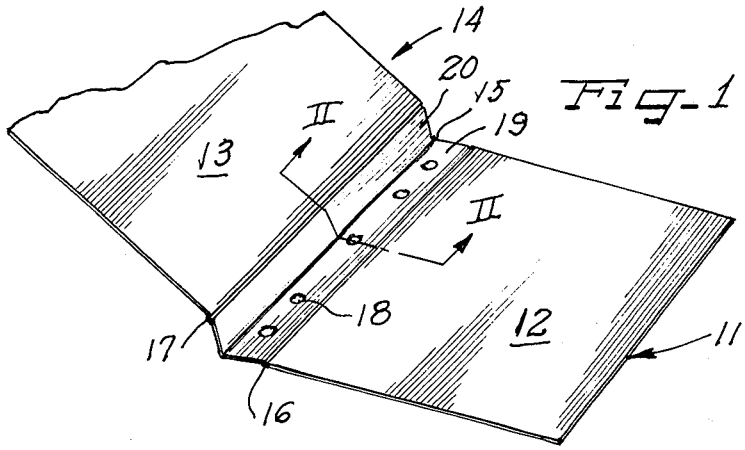
Fig-1
Fig-2
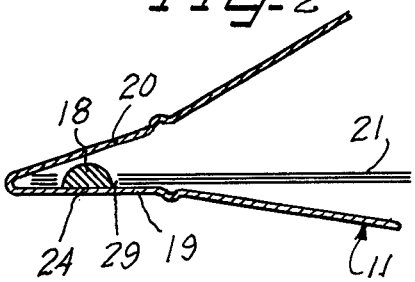
Fig-4
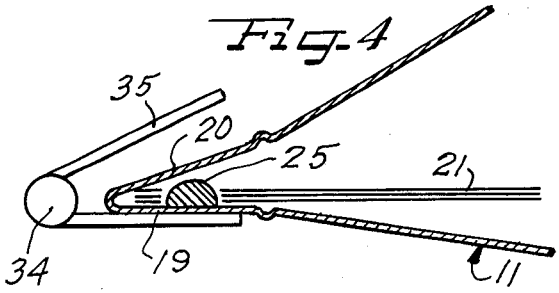
Fig-3
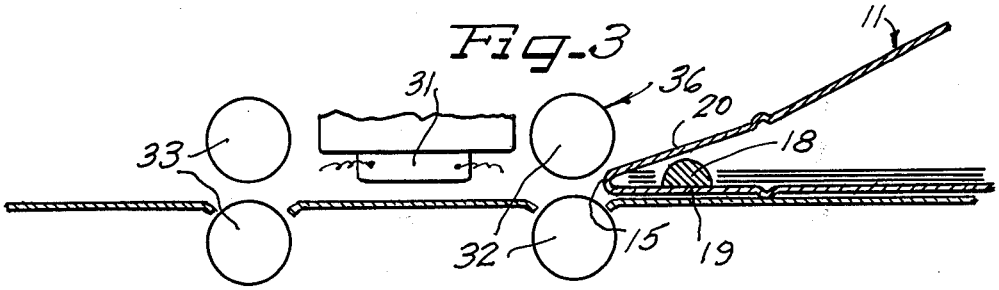
Fig-5
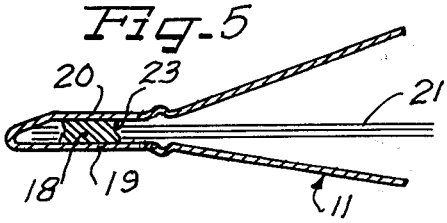
Fig-6
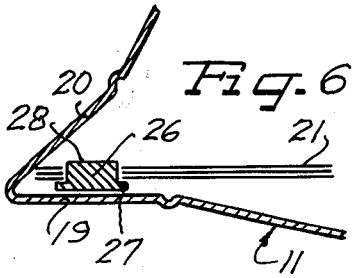
Fig-7
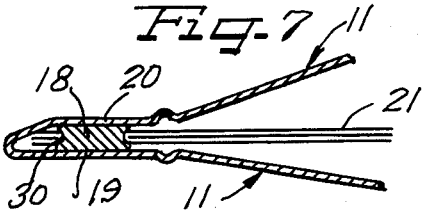

HOT MELT ADHESIVE DOT BINDING

BACKGROUND OF THE INVENTION

1. Field of the Invention

This invention relates to a method and apparatus for binding sheets of paper inside a cover and more particularly to a permanent binding which utilizes pre-punched holes in the paper sheets.

2. Description of the Prior Art

Sheets of paper containing punched or drilled holes frequently are employed where it is desirable to bind and unbind a book as in ring looseleaf or post binders.

However, several binding methods employ sheets containing holes where unbinding is not contemplated. Examples are plastic loops and/or spiral wire. Uses for such permanent bindings include sales literature, typed or written reports, legal briefs, etc. as employed in schools, business, and industry.

A disadvantage with prior, permanent binding methods is the necessity of introducing mounting holes into the cover and the paper sheets. Also, binding methods such as spiral wire or plastic loops must be carefully threaded through the cover and paper sheets, resulting in slow production time and expensive machinery.

If the permanent binding mechanism utilizes protrusion through all the holes in a standard five hole paper sheet, then the binding is not compatible with a standard three hole sheet since two of the protrusions would not pass through the papers.

SUMMARY OF THE INVENTION

According to the invention, a binding method and apparatus is disclosed for permanently attaching a cover to paper sheets with pre-punched holes.

The cover is folded at the center along a center score to form front and rear leaves. Five hot melt adhesive dots are placed on the rear leaf adjacent to the center score. Each dot is aligned to permit engagement with pre-punched holes in the paper sheets to be bound. Furthermore, the diameter of the dots is chosen slightly smaller than that of the paper holes and the height is chosen to at least exceed the total thickness of all paper sheets to be bound.

After insertion and alignment of the paper sheets over the dots, the front leaf is folded over into contact with tops of the dots. The cover is introduced into a laminator where heat is applied to melt the tops of the dots into adhesive contact with the inside surface of the front leaf.

If use with three hole paper is desired, two of the dots may be scraped off or only three dots initially deposited.

Each leaf is scored parallel with the center score to permit folding back of the leaves without over-stressing the bonds between the dots and the leaves.

It is an object of this invention to provide a new binding method for permanently attaching covers to paper sheets.

It is a further object of this invention to utilize hot melt adhesive dots as a retaining means which can be quickly and inexpensively employed to permanently attach paper sheets with pre-punched holes to a cover.

It is another object of this invention to utilize as a retaining means hot melt adhesive dots which are deposited on an inside surface of a cover leaf as so as to align with pre-punched holes.

It is a further object of this invention to provide adhesive dots which can be scrapped off, thus permitting a cover with five dots originally to be compatible with three hole paper.

It is another object of this invention to utilize hot melt adhesive dots as a retaining means, the bottom of which is melted to a rear cover leaf and the top of which is melted to a front cover leaf after placement of the paper sheet holes over the dots.

It is a further object of this invention to permit a single machine to laminate and bind the cover in a single operation, thus saving time and expense.

BRIEF DESCRIPTION OF THE DRAWINGS

FIG. 1 is a perspective view of a preferred embodiment of a binder prior to insertion of the paper sheets.

FIG. 2 is a fragmentary cross sectional view taken along line I—I showing the paper sheets in position prior to adhesion of the front leaf to the dot tops.

FIG. 3 is a side view illustrating one embodiment of apparatus for the application of heat and pressure to the tops of the adhesive dots.

FIG. 4 is a side view illustrating the use of a second bar sealer embodiment to heat and press the tops of the adhesive dots.

FIG. 5 is a fragmentary cross sectional view taken along line I—I after the dot tops are melted into adhesive contact with the front leaf to form a book.

FIG. 6 is a fragmentary cross sectional side view of a hot melt rivet embodiment prior to adhesion with the rear and front leaves.

FIG. 7 is a fragmentary cross sectional side view of a further embodiment using a large hot melt dot which was allowed to flow into contact with the paper hole sides during heat application.

DESCRIPTION OF THE PREFERRED EMBODIMENTS

Referring to FIG. 1 generally, a binder 14 is illustrated having a cover 11. Rear and front leaves 12 and 13 are created by folding the cover 11 along a center score 15. Five hot melt adhesive dots 18 are positioned along the center score 15. Front and rear scores 17 and 16 are provided parallel to the center score 15 and spaced therefrom by the dots to permit flexing of the leaves when the dots are melted into adhesion with the front and rear leaves.

The cover 11 is typically comprised of paper stock whose thickness ranges from 0.008 to 0.012 inch. The cover is cut to size with each leaf 12 or 13 slightly larger than paper sheets 21 which it is intended to enfold. The center score 15 is provided down a middle of the cover 11 to permit folding into front and rear leaves 13 and 12 of equal size. Two additional front and rear scores 17 and 16 are added to the cover, one for each leaf. The scores are parallel to and spaced ½ to ¾ on either side of the center score 15. As noted above, between these scores and the center score, front and rear surfaces 20 and 19 are created which provide the adhesion surfaces for hot melt adhesive dots 18 described below.

The front and rear scores 17 and 16 permit flexing of the leaves. When the front and rear sufaces 20 and 19 are bound together by the hot melt dots 18, the dots are not stressed since the leaves bend at the front and rear scores as the cover 11 is folded open.

The hot melt adhesive dots 18 are hot applied to the rear surface 19. This adhesive is described in co-pending U.S. Ser. No. 265,305 and is hot applied in discrete round dots and then cooled into adhesive contact with the inside surface of rear leaf 12. The size of the dots 18 is controlled so that the diameter of their bases 24 is slightly smaller than that of the paper holes 29 described below. Each dot is in the shape of an approximate hemisphere 25.

The placement of the hot adhesive dots 18 on the inner rear surface 19 can be easily automated for commercial operations using equipment presently on the market manufactured by the Nordstrom Company. For small scale operations, an automatic glue gun such as Weller Model 2400 will suffice.

The dots 18 are positioned on the inside rear surface 19 of the rear leaf 12 within the space between the center score 15 and rear score 16. If five hole paper sheets 21 are used as in the preferred embodiment, then five dots 18 are deposited on the rear surface 19 in alignment with the paper holes 29. However, the technique is suitable for use with paper sheets having any punched hole pattern or hole shape.

The paper sheets 21 having holes 29 are bound to the cover 11 by positioning the holes 29 in register with the dots 18 as shown in FIG. 2. This step is performed after the dots have cooled. The total thickness of all the sheets to be bound must be slightly less than the height of the dots so that the inside front surface 20 will contact the top of the protruding hemisphere 25.

The binding operation is completed by melting the tops of the dots 18 into adhesive contact with the inside front surface 20. This can be accomplished by any convenient process.

In one binding method, the cover 11 is introduced, center score 15 end first, into a laminator 36, of the type described in co-pending U.S. Ser. No. 29,559. Feeder 32 transports the binder 14, heater 31 melts the dots 18, and pressing rollers 33 press the dot into adhesive contact with the front surface 20. Melted tops 23 constituting a flared out contact surface are created by this process as shown in FIG. 5. As the cover leaves the laminator 36, the adhesive cools, hardens, and secures the rear surface 19 to the front surface 20 by the dots 18 passing through the paper holes 29. The laminator need have only one heater 31 since the cover is inserted with the top of the unmelted dot 18 towards the heater.

The binding operations need not be restricted to a laminator, but can be performed with so-called bar sealing equipment well known in the film bag making industry. Referring to FIG. 4, a hinge 34 with a heated top member 35 is closed upon the edge formed at the center score 15 to melt and press the tops of the dots 18. However, the virtue of employing a laminator is that the machine will laminate and bind, hence two separate machines are unnecessary.

As noted above, the total thickness of the paper sheets 21 must be slightly less than the height of the dots 18. As a result of the hemispherical shape 25, the height of the dots 18 is approximately one-fourth of its diameter. Hence, the maximum number of sheets which can be bound is related to the size of the punched holes 29 which circumscribe the dot diameters. For example, a dot 18 having a height of 0.07 will bind 20 20 lb. sheets of paper whose individual thickness is 0.0035 . The base 24 of the dot will be approximately $4 \times 0.070 = 0.280$, a diameter which easily receives a paper hole size 0.312 (5/16), typical of punched paper employed by students. These are not hard and fast requirements, since the temperature of the hot melt adhesive at time of casting and its cooling rate affect the dot dimensions. Generally, however, the larger the number of sheets to be bound, the larger the holes 29 in the sheets 21 must be.

An alternate embodiment of this invention is illustrated by FIG. 6. Hot melt rivets 26 are fabricated having the shape of a cylinder with a flat top 28 and bottom flange 27. These rivets are inserted into the holes 29 of the paper sheets 21 either from the above or from below, as shown. The assembly is placed within the folded cover 11. The flat tops 28 of the rivets are then melted into adhesive contact with both the inside front and rear surfaces 20 and 19.

A binder 14 of greater integrity can be fabricated by using close fitting rivets 37 as shown in FIG. 7. These are subsequently heated at high temperature regimes or for longer periods to allow the hot melt adhesive to flowmore completely and bind the edges 30 of the punched holes as well as bind the front and rear surfaces 20 and 19.

Rather than having the cylindrical shape described above, the rivets may be shaped as round balls of hot melt adhesive and dropped into the holes 29 formed by a stack of paper sheets 21. The diameter of the ball must be larger than the paper to be bound.

Although the cover 11 is described as being paper stock above, thin and linear polyethylene covers have been employed in place of paper. Use of this material requires that the temperature used for melting the dots 18 or rivets 26 must be kept at a temperature below the softening point of the linear polyethylene, yet adequate to melt the hot adhesive.

Where paper sheets 21 having a standard three hole arrangement are used with a cover 11 having five dots 18 already deposited thereon, the two excessive dots can be easily picked off with a scratch of a fingernail. Hence, the cover 11 is compatible with five and three hole standard paper.

Although the dots 18 have been described as being initially hot applied to the rear surface 19 of the rear leaf 12, it is obvious that a reverse process is equally convenient. The dots 18 may be initially applied to the front surface 20 and later melted to the rear surface 19.

In addition to binding paper sheets, this invention is equally useful in securing plastic sheets or paper sheets covered with a laminant.

Although the teachings of my invention have herein been discussed with reference to specific theories and embodiments, it is to be understood that others may wish to utilize my invention in different designs or applications.

I claim as my invention:

1. A method of securing sheets with a prepunched hole pattern to a cover having first and second leaves folded together comprising the steps of:

a. depositing hot melt units having a convex-shaped upper surface into adhesive contact with said first leaf according to said hole pattern, said units projecting upwardly substantially above said first leaf;

b. positioning said sheets on said first leaf with said prepunched holes in alignment with and surrounding said adhesive units, the diameter of said holes being larger than the largest diameter of said hot melt units;

c. folding said second leaf over into contact with tops of the convex-shaped upper surfaces of said adhesive units, said convex tops extending above said prepunched holes; and d. heating said tops to flatten said convex tops to form an adhesive contact between said flattened tops of the adhesive units and said second leaf.

2. The method of claim 7 wherein the step of folding includes the steps of bending at a center score and at first and second scores on said first and second leaves, respectively, to promote folding together of said first and second leaves without stressing said adhesive contacts.

* * * * *